US007380771B1

(12) United States Patent
Joy et al.

(10) Patent No.: US 7,380,771 B1
(45) Date of Patent: Jun. 3, 2008

(54) PROTECTIVE LIFTING SYSTEM FOR OUTDOOR USE

(76) Inventors: Colin Joy, 1075 Dillon Rd., Columbia Falls, MT (US) 59912; Rick Faller, 1075 Dillon Rd., Columbia Falls, MT (US) 59912

( * ) Notice: Subject to any disclaimer, the term of this patent is extended or adjusted under 35 U.S.C. 154(b) by 0 days.

(21) Appl. No.: 11/704,864

(22) Filed: Feb. 9, 2007

(51) Int. Cl.
*B66D 1/00* (2006.01)

(52) U.S. Cl. ..... 254/394; 254/391

(58) Field of Classification Search ..... 254/391, 254/393, 394, 399, 408, 374
See application file for complete search history.

(56) References Cited

U.S. PATENT DOCUMENTS 6,068,242 A * 5/2000 Kingery ..... 254/391
6,631,885 B2 * 10/2003 Halas ..... 254/225
6,685,171 B2 * 2/2004 Lob et al. ..... 254/391
7,007,927 B2 * 3/2006 Halas ..... 254/225
7,066,451 B1 * 6/2006 Balcom ..... 254/226
7,093,823 B2 * 8/2006 Sevalie' ..... 254/337
7,111,572 B1 * 9/2006 Yang ..... 114/199

* cited by examiner

*Primary Examiner*—Emmanuel M Marcelo
(74) *Attorney, Agent, or Firm*—Stinson Morrison Hecker LLP; Adam H. Jacobs

(57) ABSTRACT

A protective lifting system includes first and second mounting hooks each having, respectively, a line and pulley connection eyelet ring mounted thereon and a mounting bar connection eyelet ring mounted thereon which extends generally perpendicular to the shank section of the mounting hook, a pulley device mounted on the second mounting hook, a lift line having a first end connected to the first mounting hook and a second end which extends through the pulley device, a mounting bar operative to engage the mounting bar connection eyelet ring on the first and second mounting hooks to lift the hooks into an elevated supported position, the lift line being operative to lift an object to a safe elevated position by drawing the second end of the lift line through and away from the pulley device thereby decreasing the length of the lift line extending between the first and second mounting hooks.

11 Claims, 3 Drawing Sheets

PROTECTIVE LIFTING SYSTEM FOR OUTDOOR USE

BACKGROUND OF THE INVENTION

1. Technical Field

The present invention is directed to food and backpack hanging systems for use by campers and other outdoorsmen and, more particularly, to a protective lifting system for objects for suspending the objects in an elevated position which includes first and second mounting hooks each having, respectively, a line and pulley connection eyelet ring mounted thereon and a mounting bar connection eyelet ring mounted thereon which extends generally perpendicular to the shank section of the mounting hook, a pulley device mounted on the second mounting hook, a lift line having a first end connected to the first mounting hook and a second end which extends through the pulley device, a mounting bar having a topmost engagement section which is operative to engage the mounting bar connection eyelet ring on the first and second mounting hooks to lift the hooks into an elevated position for engagement on a supporting object with the lift line extending therebetween, the lift line being operative to lift an object to be protected and supported thereon by drawing the second end of the lift line through and away from the pulley device thereby decreasing the length of the lift line extending between the first and second mounting hooks whereby the object is lifted into an elevated position supported between the first and second mounting hooks.

2. Description of the Prior Art

Each year, untold numbers of people visit wilderness areas for hunting, fishing, hiking, and many other outdoor activities. While these visits are, for the most part, exciting and enjoyable, visits and stays in wilderness areas also bring certain risks into play which are not encountered in ordinary daily life. Specifically, when visiting wilderness areas, persons must be aware that animals will often take an interest in their activities, particularly if the animals become aware of foodstuffs, toiletries or garbage which are being carried by the persons visiting the wilderness area. For example, one of the largest and potentially most dangerous animals frequently encountered in wilderness areas is the bear, particularly black bears, and these intelligent and curious animals spend a great deal of time exploring for food. This activity can bring them into close contact with humans, particularly since bears mainly rely on their sense of smell to locate foodstuffs and therefore the foodstuffs being carried by persons in wilderness areas may become targets of bears in order to satisfy their hunger.

In particular, hikers and campers often encounter bears in wilderness areas, and it is necessary for these persons to take precautions when entering the bears' habitat. Most commonly, hikers and campers store their food, toiletries, and garbage in either bear resistant containers or in what are commonly referred to as "food hangs." While hikers and campers would ideally carry bear resistant containers for their food, toiletries, and garbage with them, most bear resistant containers are bulky and heavy and are difficult to transport during hiking and camping. Therefore, the majority of hikers and campers use food hangs which usually consist of a long rope or cable which is draped over separate trees spaced at least twenty to thirty feet apart and which are at least fifteen feet high. The hiker/camper would then throw the rope over the first tree, transport the rope to the second tree and throw the rope over the second tree, then attach the food bag to the center of the rope where it is approximately equidistantly spaced from the two trees, then the ends of the rope would be pulled to lift the bag or pack containing the food, toiletries and/or garbage up into the air to suspend the bag or pack between the trees. The ends of the rope would then be secured to the tree by an appropriate means such as a knot or other such tie-off and the food hang would thus be completed.

It is easy to see, however, how the ordinary method of preparing and completing a food hang is a cumbersome and time-consuming process. For example, one must extend the rope over two selected trees, with all the attendant difficulties inherent in performing such an action, due to the numerous branches, twigs and leaves which are in the way when the rope is being thrown over a particular selected branch. Furthermore, one must be sure that the securing knots which are tying the rope in the selected position do not slip or give way which would result in the hanging food bag dropping to the ground. Also, one must ensure that the branch selected is of sufficient strength to support the hanging bag, and because of the method by which the rope is thrown over the branch, it may be difficult to select and accurately throw the rope over an appropriate branch unless one is quite skilled in the art of rope throwing. Therefore, there is a need for an improved object lifting and hanging system which addresses and corrects many of the deficiencies found in the prior art devices and systems.

Therefore, an object of the present invention is to provide an improved protective lifting system for objects for suspending objects in an elevated position.

Another object of the present invention is to provide an improved protective lifting system for objects which may be quickly and easily used in virtually any location in the wilderness and which may be used by most any hiker, camper, hunter, or fisherperson who is concerned about and wants to avoid keeping food, toiletries and/or garbage on the ground near their camping or resting location.

Another object of the present invention is to provide an improved protective lifting system for objects for suspending the objects in an elevated position which includes first and second mounting hooks which may be quickly and easily placed on spaced elevated supporting objects such as trees with a lift line extending between the first and second mounting hooks and through a pulley device on the second mounting hook such that merely by drawing the lift line through the pulley when the first and second mounting hooks are mounted on the supporting objects, the lift line will lift the object secured thereto in a simple and efficient manner.

Another object of the present invention is to provide a protective lifting system for objects for suspending the objects in an elevated position which utilizes an extendable or longitudinally extended mounting bar which releasably connects to a mounting bar connection eyelet ring, one mounted on each of the first and second mounting hooks for lifting the first and second mounting hooks into an elevated position engaging the supporting object, thus permitting quick and efficient placement of the first and second mounting hooks on the supporting objects.

Another object of the present invention is to provide a protective lifting system for objects for suspending the objects in an elevated position which will generally prevent fraying and degradation of the supporting rope, cord or cable which results from frictional contact between the rope, cord or cable with the tree or other such supporting object commonly used for support of food hangs.

Finally, an object of the present invention is to provide a protective lifting system for objects for suspending objects in an elevated position which is relatively simple and durable in construction and is safe, efficient and effective in use.

SUMMARY OF THE INVENTION

The present invention provides a protective lifting system for objects for suspending the objects in an elevated position which includes a first mounting hook having a generally arcuate engagement hook section and a generally straight connecting shank section having a line connection eyelet ring mounted thereon and a mounting bar connection eyelet ring mounted on one of the shank section and the line connection eyelet ring, the mounting bar connection eyelet ring extending generally perpendicular to the shank section and a second mounting hook having a generally arcuate engagement hook section and a generally straight connecting shank section having a pulley connection eyelet ring mounted thereon and a mounting bar connection eyelet ring mounted on one of the shank section and the line connection eyelet ring, the mounting bar connection eyelet ring extending generally perpendicular to the shank section. A pulley device is mounted on the pulley connection eyelet ring of the second mounting hook, the pulley device including a pulley body and a pulley wheel rotatably mounted thereon and a lift line having a first end connected to the line connection eyelet ring of the first mounting hook and a second end extends through the pulley device over the pulley wheel. A mounting bar is included, the mounting bar having an extended shaft and a topmost engagement section for releasably engaging the mounting bar connection eyelet rings of the first and second mounting hooks to lift the first mounting hook into an elevated position where the engagement hook section engages a supporting object and lift the second mounting hook into an elevated position where the engagement hook section engages a supporting object, the first and second mounting hooks being spaced from one another with the lift line extending therebetween. Finally, the lift line is operative to lift an object to be protected and supported thereon by drawing the second end of the lift line away from the pulley device supported on the pulley connection eyelet ring of the second mounting hook thereby decreasing the length of the lift line extending between the line connection eyelet ring of the first mounting hook and the pulley device supported on the pulley connection eyelet ring of the second mounting hook whereby the object is lifted into an elevated position supported between the first and second mounting hooks via connection to the lift line.

The protective lifting system for objects for suspending the objects in an elevated position of the present invention as thus described provides many improvements over those devices and systems found in the prior art. For example, because the present invention utilizes mounting hooks for securement of the system to the supporting objects, the mounting connection of the device to those supporting objects is far more secure than that obtainable by merely passing the supporting cable or cord over the supporting object. Also, because the first and second mounting hooks of the present invention include mounting bar connection eyelet rings which extend generally perpendicular to the shank section of the mounting hooks, it is a relatively simple matter to engage the mounting bar connection eyelet rings with a mounting bar including a topmost engagement section to lift the first and second mounting hooks into a support position engaging the supporting object instead of having to throw a rope or cord over the selected supporting object in a precise location to ensure that the supporting line is properly supported by the supporting object. Finally, because the present invention includes a pulley device mounted on the second mounting hook through which the lift line extends, wear and tear from frictional contact between the lift line and the supporting object is eliminated, thus greatly increasing the usable life span of the lift line and significantly decreasing the chances that the lift line will break at an inopportune time, such as during the lifting of or supporting of an object by the lift line. It is therefore seen that the present invention provides a substantial improvement over those devices and systems found in the prior art which attempt to perform similar functions.

DESCRIPTION OF THE PREFERRED EMBODIMENT

Figure 1:
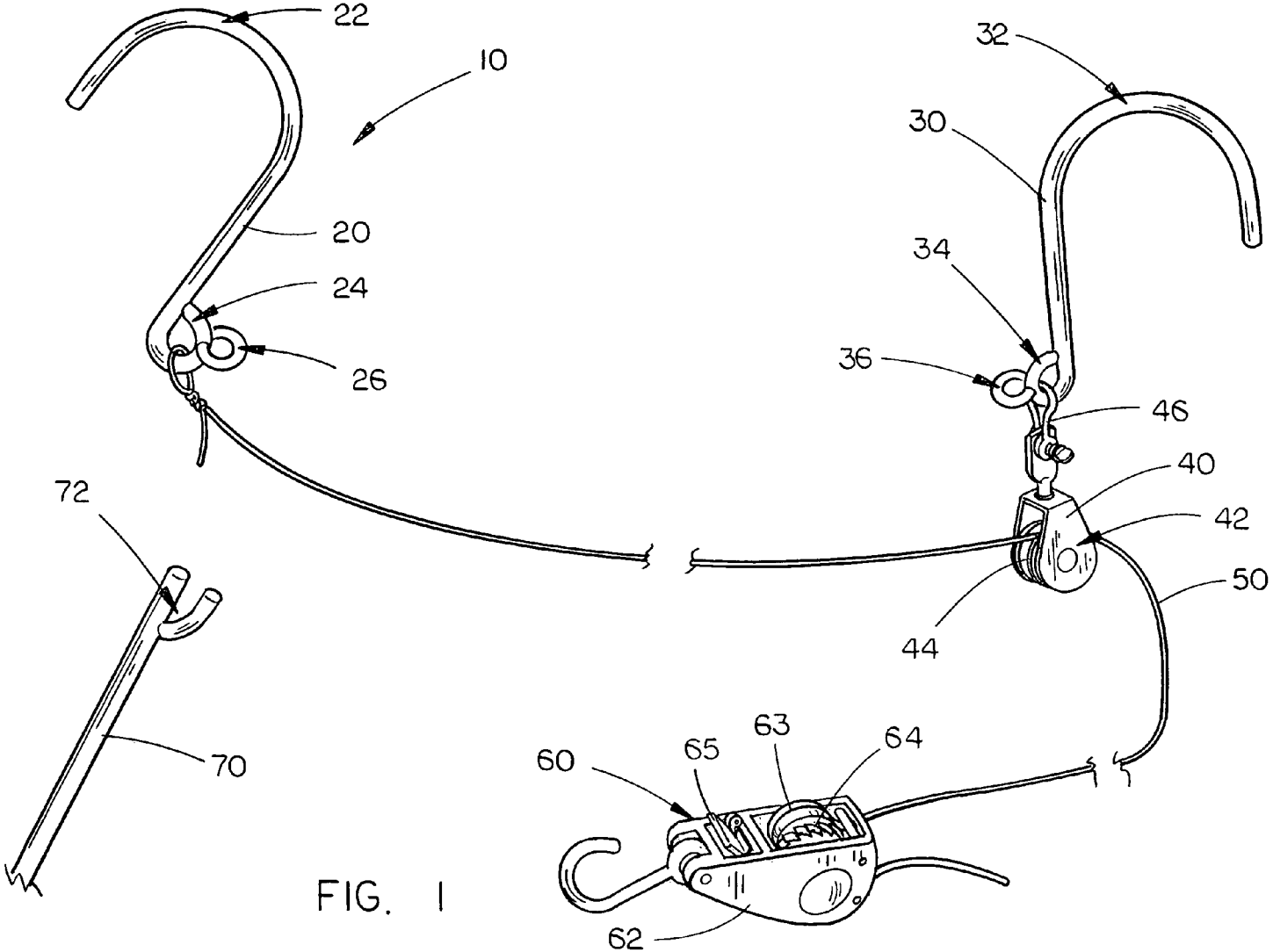
FIG. 1 is a perspective view of the protective lifting system for objects of the presenting invention showing each of the elements thereof.
Figure 2:
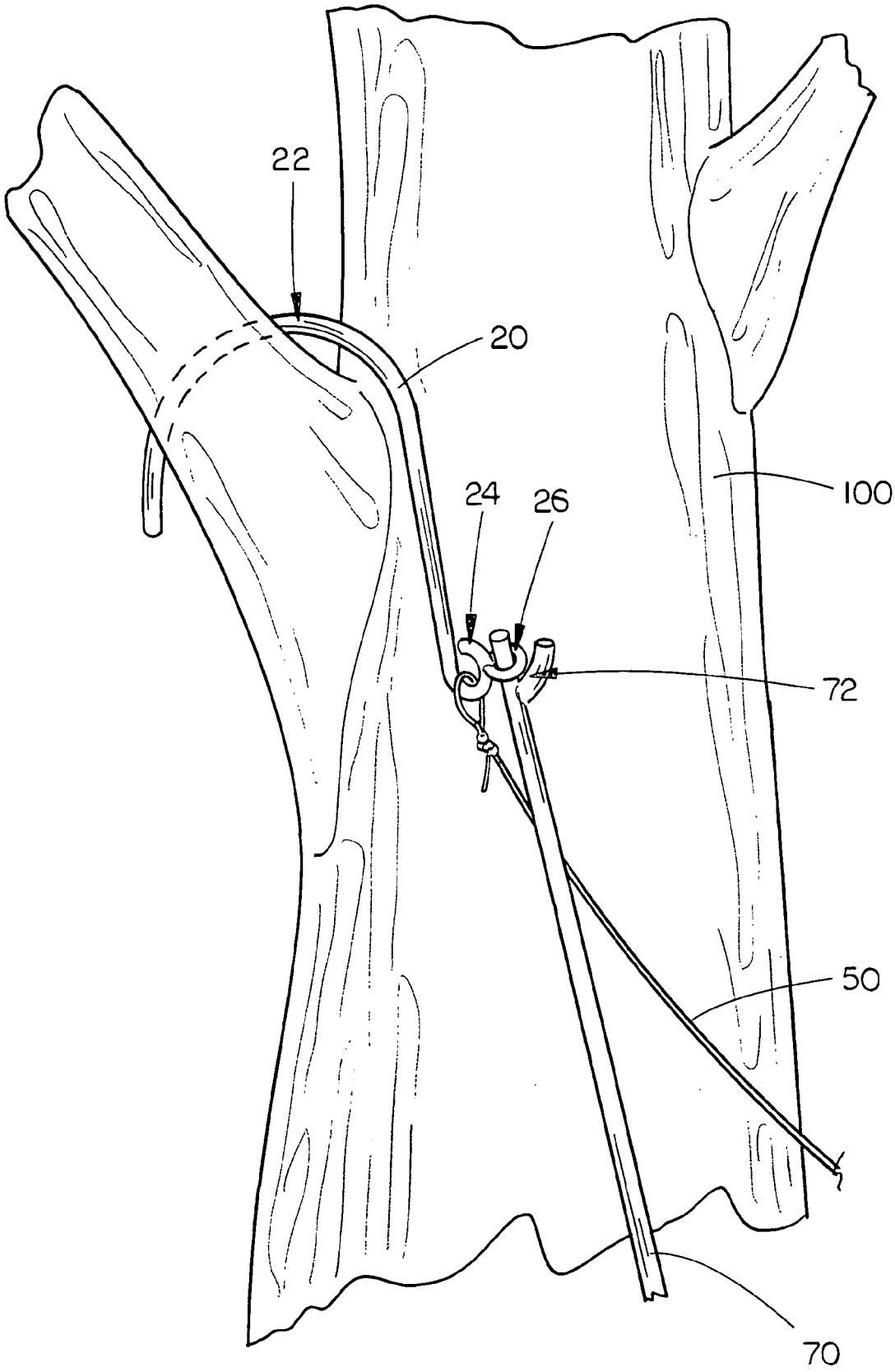
FIG. 2 is a detailed perspective view of the first mounting hook of the present invention being lifted into a support location on a selected tree.
Figure 3:
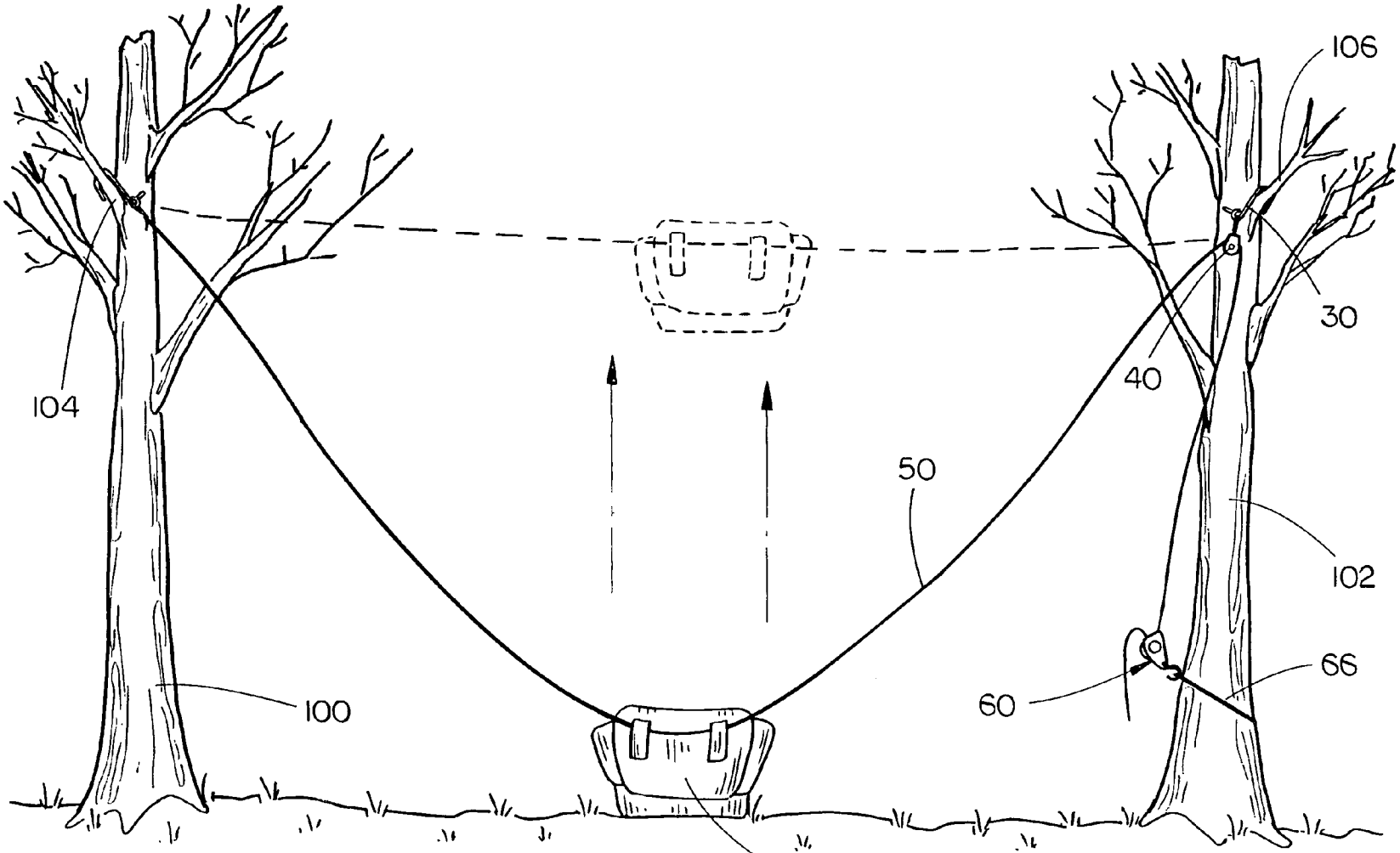
FIG. 3 is a side elevational view of the present invention being used to lift a backpack into an elevated position suspended between two selected trees, the backpack being supported on the lift line.

The protective lifting system 10 for objects for suspending the objects in an elevated position is shown best in FIGS. 1-3 as including a first mounting hook 20 which includes an arcuate hook section 22, a line connection eyelet ring 24 mounted on the shank end of the mounting hook 20 and a mounting bar connection eyelet ring 26 which is mounted on the line connection eyelet ring 24. In the preferred embodiment, the mounting bar connection eyelet ring 26 would extend perpendicularly to the line connection eyelet ring 24 and hence perpendicular to the hook section 22 of first mounting hook 20. This makes it easier for the mounting bar connection eyelet ring 26 to be engaged by a mounting bar 70 as will be described later in this disclosure.

A second mounting hook 30 is also included in the present invention, the second mounting hook 30 including a hook section 32 generally identical to first mounting hook 20, a pulley connection eyelet ring 34 generally identical to line connection eyelet ring 24 of first mounting hook 20 and a mounting bar connection eyelet ring 36 which is generally identical to mounting bar connection eyelet ring 26 of first mounting hook 20. In effect, first and second mounting hooks 20 and 30 would be generally identical to one another, although it is not specifically necessary that the mounting hooks be identical, as there may be situations where having differently sized and shaped mounting hooks would be beneficial in mounting the first and second mounting hooks 20 and 30 on selected supporting objects.

Mounted on second mounting hook 30 and depending downwards therefrom is a main pulley 40 which, in the preferred embodiment, would be a standard type pulley including a pulley body 42 and pulley wheel 44 rotatably mounted therein, the main pulley 40 being mounted on the pulley connection eyelet ring 34 of second mounting hook 30 by a pulley mount clasp 46 or any other appropriate connecting or mounting device. It is preferred that the main pulley 40 be constructed of weather-resistant materials which generally do not require lubrication to ensure proper rotation of the pulley wheel 44 on pulley body 42, although the precise size, shape and type of main pulley 40 used in connection with the present invention is not critical so long as the functionality of the main pulley 40 is neither significantly degraded nor destroyed.

The lift line 50 which extends between the first and second mounting hooks 20 and 30 would preferably be a weather-resistant rope or cord, although a lightweight metal cable may also be used for the lift line 50 so long as the intended purpose of providing an easily manipulated and stored length of lift line 50 which will support a significant amount of weight thereon is maintained. In the preferred embodiment, the lift line 50 would include a first end which would be connected to the line connection eyelet ring 24 of first mounting hook 20 and the second end which would extend through the main pulley 40 around pulley wheel 44 and therethrough, as shown best in FIGS. 1 and 3. The end of the lift line 50 may then be connected to a lifting ratchet device 60 which, in the preferred embodiment, would be a rope ratchet or the like which is of a standard design and includes an outer body 62, a line gripping wheel 63 rotatably mounted within the outer body 62 and a ratchet mechanism 64 with a release lever 65, the ratchet mechanism 64 operatively connected to the line gripping wheel 63 as follows. The lift line 50 passes through the rope ratchet outer body 62 around the line gripping wheel 63 such that when the lift line 50 is pulled, the line gripping wheel 63 rotates and the ratchet mechanism 64 keeps the line gripping wheel 63 from rotating backwards, allowing easy, one-hand tensioning of the lift line 50. Pushing the release lever 65 up disengages the ratchet mechanism 64 and releases the line gripping wheel 63 for reversed rotation thereof so that the lift line 50 may be detensioned. Of course, use of the lifting ratchet device 60 is not critical with the present invention, and in fact it may be a far simpler matter for the user of the present invention to merely draw the lift line through the main pulley 40 to tighten the lift line 50, then secure the end of the lift line 50 to an appropriate support location. However, one of the benefits of the use of the lifting ratchet device 60, which would preferably operate in a standard rope ratchet manner, is that persons of limited size and strength may quickly and easily lift even quite heavy objects up into the air via the present invention, and further, the use of the lifting ratchet device 60 eliminates the requirement of securing the end of the lift line 50 once the object has been lifted into the air. It is thus seen that use of the lifting ratchet device 60 renders use of the present invention a far simpler and more efficient process.

The present invention would be used in the manner shown in FIGS. 2 and 3 and would include the following steps. First of all, the first mounting hook 20 would be lifted into the air via connection to the mounting bar 70, which includes V-shaped engagement notch 72, to the mounting bar connection eyelet ring 26, as shown in FIG. 2. The first mounting hook 20 would then be positioned on a selected tree 100 with the hook section 22 of the first mounting hook 20 extending over the selected branch 104 of tree 100 which would be used to support the first mounting hook 20 thereon. In a similar manner, second mounting hook 30 would be mounted on another tree 102, as shown in FIG. 3, with the hook section 32 of second mounting hook 30 extending over a selected branch 106 of the second tree 102. It is preferred that the trees 100 and 102 be spaced apart from one another at least twenty to thirty feet, as the ideal location for the pack 200 to be suspended would be at least ten to fifteen feet away from the main trunk of the tree. Furthermore, it is preferred that the selected branches 104 and 106 be at least fifteen to twenty feet in height in order to ensure that the supported pack 200 will be positioned at least fifteen feet above the ground surface, as recommended by bear and wildlife experts. In any event, once the first and second mounting hooks 20 and 30 are placed on their respective trees 100 and 102, the lift line 50 would extend between the first and second mounting hooks 20 and 30 as shown by the solid line of FIG. 3 where the pack 200 is still resting on the ground surface. The second end of the lift line 50 would then be inserted into the lifting ratchet device 60 and the ratchet device tie-down 66 would be connected to the tree 102 to secure the lifting ratchet device 60 in the selected location as shown in FIG. 3. The lifting ratchet device 60 would then be operated as described previously thus drawing lift line 50 through the lifting ratchet device 60 therefore pulling the lift line 50 through main pulley 40 over pulley wheel 44 towards the lifting ratchet device 60. This decreases the length of the lift line 50 which extends between the first and second mounting hooks 20 and 30, thus pulling the pack 200 upwards into the air to be suspended between the trees 100 and 102. Once the lift line 50 has been drawn through the main pulley 40 and the lifting ratchet device 60 the desired amount, the pack 200 is suspended above the ground between the trees 100 and 102 on lift line 50, as shown by the dotted lines of FIG. 3. All of the objects stored in the pack 200 are thus protected from unauthorized incursion by wildlife, and therefore the persons utilizing the present invention may feel relatively safe and secure that their food, toiletries and/or garbage are protected from unauthorized incursion.

To lower the pack 200 back to the ground surface, the release lever 65 of the lifting ratchet device 60 would be disengaged to release the ratchet mechanism 64 and allow the lift line 50 to run out through the lifting ratchet device 60 thus lowering the pack 200. Once the pack 200 is lowered to the ground surface, the protective lifting system 10 of the present invention may be removed from the trees 100 and 102 merely by reversing the procedures previously described. The elements of the present invention may then quickly and easily be stored in the backpack or carrying sack of the persons using the invention, and the invention may then be used in another location.

It is to be understood that numerous additions, modifications and substitutions may be made to the protection system 10 of the present invention which fall within the intended broad scope of the appended claims. For example, the precise size, shape and construction materials used in connection with the first and second mounting hooks 20 and 30, main pulley 40 and lifting ratchet device 60 may be modified or changed so long as the intended functional features of those elements are neither significantly degraded nor destroyed. Furthermore, the particular type of cord, rope or cable used for the lift line 50 may be modified or changed depending on the weight of the pack or bag to be supported thereby and the weight and size constraints desired by the user of the present invention, so long as the functional aspects of the lift line 50 remain generally intact. Also, the precise size and shape of the mounting bar 70 may be modified or changed so long as the intended functional feature of the mounting bar 70, particularly that it is operative to lift the first and second mounting hooks 20 and 30 into their support position, is maintained. For example, the mounting bar 70 may be a telescoping aluminum pole having an extendable shaft which will permit the user of the present invention to mount the first and second mounting hooks 20 and 30 in many different locations at many different heights. Finally, it should be noted that the use of the lifting ratchet device 60 is preferred in connection with the present invention, as it makes lifting of the pack 200 into the air a far easier and safer procedure, although it should be noted that the exact design of the lifting ratchet device 60 is not critical to the present invention so long as the intended functional features are maintained.

There has therefore been shown and described a protective lifting system 10 for suspending objects in an elevated position which accomplishes at least all of its intended objectives.

We claim:

1. A protective lifting system for objects for suspending the objects in an elevated position comprising:

a first mounting hook having a generally arcuate engagement hook section and a generally straight connecting shank section having a line connection eyelet ring mounted thereon and a mounting bar connection eyelet ring mounted on one of said shank section and said line connection eyelet ring, said mounting bar connection eyelet ring extending generally perpendicular to said shank section;

a second mounting hook having a generally arcuate engagement hook section and a generally straight connecting shank section having a pulley connection eyelet ring mounted thereon and a mounting bar connection eyelet ring mounted on one of said shank section and said line connection eyelet ring, said mounting bar connection eyelet ring extending generally perpendicular to said shank section;

a pulley device mounted on said pulley connection eyelet ring of said second mounting hook, said pulley device including a pulley body and a pulley wheel rotatably mounted thereon;

a lift line having a first end connected to said line connection eyelet ring of said first mounting hook and a second end extending through said pulley device over said pulley wheel;

a mounting bar having an extended shaft and a topmost engagement section for releasably engaging said mounting bar connection eyelet rings of said first and second mounting hooks to lift said first mounting hook into an elevated position where said engagement hook section engages a supporting object and lift said second mounting hook into an elevated position where said engagement hook section engages a supporting object, said first and second mounting hooks being spaced from one another with said lift line extending therebetween; and said lift line operative to lift an object to be protected and supported thereon by drawing said second end of said lift line away from said pulley device supported on said pulley connection eyelet ring of said second mounting hook thereby decreasing the length of said lift line extending between said line connection eyelet ring of said first mounting hook and said pulley device supported on said pulley connection eyelet ring of said second mounting hook whereby the object is lifted into an elevated position supported between said first and second mounting hooks via connection to said lift line.

2. The protective lifting system of claim 1 further comprising a lifting ratchet device including an outer body, a line gripping wheel rotatably mounted within said outer body and a ratchet mechanism having a release lever, said ratchet mechanism operatively connected to said line gripping wheel such that said lift line passes through said outer body and around said line gripping wheel such that when said lift line is pulled, said line gripping wheel engages said lift line and rotates and said ratchet mechanism restricts said line gripping wheel from rotating in the opposite direction when engaged whereby said lift line is prevented from detensioning until said ratchet mechanism is released.

3. The protective lifting system of claim 1 wherein said first and second mounting hooks are constructed of metal.

4. The protective lifting system of claim 1 wherein said topmost engagement section of said mounting bar comprises a V-shaped engagement notch.

5. A protective lifting system for objects for suspending the objects in an elevated position comprising:

a first mounting hook having a generally arcuate engagement hook section and a generally straight connecting shank section having a line connection eyelet ring mounted thereon and a mounting bar connection eyelet ring mounted said line connection eyelet ring, said mounting bar connection eyelet ring extending generally perpendicular to said shank section;

a second mounting hook having a generally arcuate engagement hook section and a generally straight connecting shank section having a pulley connection eyelet ring mounted thereon and a mounting bar connection eyelet ring mounted on said line connection eyelet ring, said mounting bar connection eyelet ring extending generally perpendicular to said shank section;

a pulley device mounted on said pulley connection eyelet ring of said second mounting hook, said pulley device including a pulley body and a pulley wheel rotatably mounted thereon;

a lift line having a first end connected to said line connection eyelet ring of said first mounting hook and a second end extending through said pulley device over said pulley wheel;

a mounting bar having an extended shaft and a topmost engagement section for releasably engaging said mounting bar connection eyelet rings of said first and second mounting hooks to lift said first mounting hook into an elevated position where said engagement hook section engages a supporting object and lift said second mounting hook into an elevated position where said engagement hook section engages a supporting object, said first and second mounting hooks being spaced from one another with said lift line extending therebetween;

said lift line operative to lift an object to be protected and supported thereon by drawing said second end of said lift line away from said pulley device supported on said pulley connection eyelet ring of said second mounting hook thereby decreasing the length of said lift line extending between said line connection eyelet ring of said first mounting hook and said pulley device supported on said pulley connection eyelet ring of said second mounting hook whereby the object is lifted into an elevated position supported between said first and second mounting hooks via connection to said lift line; and a lifting ratchet device including an outer body, a line gripping wheel rotatably mounted within said outer body and a ratchet mechanism having a release lever, said ratchet mechanism operatively connected to said line gripping wheel such that said lift line passes through said outer body and around said line gripping wheel such that when said lift line is pulled, said line gripping wheel engages said lift line and rotates and said ratchet mechanism restricts said line gripping wheel from rotating in the opposite direction when engaged whereby said lift line is prevented from detensioning until said ratchet mechanism is released.

6. The protective lifting system of claim 5 wherein said first and second mounting hooks are constructed of metal.

7. The protective lifting system of claim 5 wherein said topmost engagement section of said mounting bar comprises a V-shaped engagement notch.

8. A protective lifting system for objects for suspending the objects in an elevated position comprising:

a first mounting hook having a generally arcuate engagement hook section and a generally straight connecting shank section having a line connection eyelet ring mounted thereon and a mounting bar connection eyelet ring mounted on one of said shank section and said line connection eyelet ring, said mounting bar connection eyelet ring extending generally perpendicular to said shank section;

a second mounting hook having a generally arcuate engagement hook section and a generally straight connecting shank section having a pulley connection eyelet ring mounted thereon and a mounting bar connection eyelet ring mounted on one of said shank section and said line connection eyelet ring, said mounting bar connection eyelet ring extending generally perpendicular to said shank section;

a pulley device mounted on said pulley connection eyelet ring of said second mounting hook, said pulley device including a pulley body and a pulley wheel rotatably mounted thereon;

a lift line having a first end connected to said line connection eyelet ring of said first mounting hook and a second end extending through said pulley device over said pulley wheel;

mounting means for releasably engaging said mounting bar connection eyelet rings, of said first and second mounting hooks to lift said first mounting hook into an elevated position where said engagement hook section engages a supporting object and lift said second mounting hook into an elevated position where said engagement hook section engages a supporting object, said first and second mounting hooks being spaced from one another with said lift line extending therebetween; and said lift line operative to lift an object to be protected and supported thereon by drawing said second end of said lift line away from said pulley device supported on said pulley connection eyelet ring of said second mounting hook thereby decreasing the length of said lift line extending between said line connection eyelet ring of said first mounting hook and said pulley device supported on said pulley connection eyelet ring of said second mounting hook whereby the object is lifted into an elevated position supported between said first and second mounting hooks via connection to said lift line.

9. The protective lifting system of claim 8 further comprising a lifting ratchet device including an outer body, a line gripping wheel rotatably mounted within said outer body and a ratchet mechanism having a release lever, said ratchet mechanism operatively connected to said line gripping wheel such that said lift line passes through said outer body and around said line gripping wheel such that when said lift line is pulled, said line gripping wheel engages said lift line and rotates and said ratchet mechanism restricts said line gripping wheel from rotating in the opposite direction when engaged whereby said lift line is prevented from detensioning until said ratchet mechanism is released.

10. The protective lifting system of claim 8 wherein said first and second mounting hooks are constructed of metal.

11. The protective lifting system of claim 8 wherein said mounting means comprises a mounting bar having an extended shaft and a topmost engagement section including a V-shaped engagement notch for releasably engaging said mounting bar connection eyelet rings of said first and second mounting hooks.

* * * * *